US007992970B2

(12) United States Patent
Enomoto et al.

(10) Patent No.: US 7,992,970 B2
(45) **Date of Patent: *Aug. 9, 2011**

(54) DROPLET EJECTING APPARATUS

(75) Inventors: Katsumi Enomoto, Kaiseimachi (JP); Toshiya Kojima, Kaiseimachi (JP); Kazuo Sanada, Kaiseimachi (JP)

(73) Assignee: Fujifilm Corporation, Tokyo (JP)

( * ) Notice: Subject to any disclaimer, the term of this patent is extended or adjusted under 35 U.S.C. 154(b) by 1054 days.

This patent is subject to a terminal disclaimer.

(21) Appl. No.: 11/826,939

(22) Filed: Jul. 19, 2007

(65) Prior Publication Data

US 2007/0263040 A1 Nov. 15, 2007

Related U.S. Application Data

(63) Continuation of application No. 10/950,494, filed on Sep. 28, 2004, now Pat. No. 7,314,270.

(30) Foreign Application Priority Data

Sep. 29, 2003 (JP) ..... 2003-338836

(51) Int. Cl.
*B41J 2/045* (2006.01)
*B41J 2/155* (2006.01)

(52) U.S. Cl. ..... 347/70; 347/42

(58) Field of Classification Search ..... 347/70, 347/42, 40, 47, 49, 54, 63, 65, 68, 71, 92
See application file for complete search history.

(56) References Cited

U.S. PATENT DOCUMENTS

| | | | |
|---|---|---|---|
| 6,382,780 | B1 | 5/2002 | Watanabe et al. |
| 6,869,171 | B2 | 3/2005 | Nishikawa et al. |

FOREIGN PATENT DOCUMENTS

| | | | |
|---|---|---|---|
| JP | 05261901 | A | 10/1993 |
| JP | 07081055 | A | 3/1995 |
| JP | 07156396 | A | 6/1995 |
| JP | 07178906 | A | 7/1995 |
| JP | 09150511 | A | 6/1997 |
| JP | 09239978 | A | 9/1997 |
| JP | 2001-179973 | A | 7/2001 |
| JP | 2001353871 | A | 12/2001 |
| JP | 2002-52706 | A | 2/2002 |
| JP | 2002-254635 | A | 9/2002 |
| JP | 2003-94652 | A | 4/2003 |

*Primary Examiner* — Huan H Tran

(74) *Attorney, Agent, or Firm* — Birch, Stewart, Kolasch & Birch, LLP

(57) ABSTRACT

A droplet ejecting apparatus for discharging liquid from nozzles of pressure chambers by supplying liquid from a liquid tank to said pressure chambers and then contracting said pressure chambers by means of piezoelectric elements, comprising:

pressure chamber plates forming said pressure chambers, and to which vibration plates forming walls of said pressure chambers are formed integrally; and a common liquid chamber formed in the liquid tank and connected to respective liquid supply ports of the respective pressure chambers through respective flow passages connected to said respective liquid supply ports;

wherein the liquid tank and the pressure chamber plates are mutually superimposed in a layered structure, in positions where the flow passages coincide with the liquid supply ports of the pressure chambers.

3 Claims, 4 Drawing Sheets

DROPLET EJECTING APPARATUS

This application is a Continuation of application Ser. No. 10/950,494 filed on Sep. 28, 2004, now U.S. Pat. No. 7,314,270 and for which priority is claimed under 35 U.S.C. §120; and this application claims priority of application Ser. No. 2003-338836 filed in Japan on Sep. 29, 2003 under 35 U.S.C. §119; the entire contents of all are hereby incorporated by reference.

BACKGROUND OF THE INVENTION

1. Field of the Invention

The present invention relates to a droplet ejecting apparatus, and more particularly to a droplet ejecting apparatus used in an inkjet printer or the like, for forming images on a recording medium by ejecting ink.

2. Description of the Related Art

An inkjet printer forms an image on recording paper by driving a recording head in accordance with image forming data, and ejecting ink from nozzles of the recording head. Ink ejecting apparatuses in a recording head include apparatuses based on a piezo actuator method, for example, wherein the vibration plate of a pressure chamber is caused to deform by means of a piezoelectric element (piezo element), thereby applying pressure to the pressure chamber and hence ejecting ink from the nozzle of the pressure chamber. Japanese Patent Application Publication No. 2001-179973 discloses an example of a structure for a recording head of this kind, wherein a vibration plate is installed on the upper surface of a pressure chamber plate, an ink tank is installed above the vibration plate, and piezoelectric elements are disposed in the interval between the vibration plate and the ink tank.

SUMMARY OF THE INVENTION

However, according to the recording head disclosed in Japanese Patent Application Publication No. 2001-179973, the supply passages for supplying liquid to the pressure chambers lead to a position below the pressure chambers, and the liquid must then travel upwards from this position. Therefore, if air bubbles enter into the pressure chamber, it is not possible to eliminate these air bubbles through the supply passages. Furthermore, since the vibration plate and the pressure chamber plate are separate members, there is a large number of components, and processes are required for aligning the supply ports in position, bonding the members together, and the like.

The present invention was devised with the foregoing in view, and an object thereof is to provide a droplet ejecting apparatus having a reduced number of components and a simplified structure.

In order to achieve the aforementioned object, the present invention provides a droplet ejecting apparatus for discharging liquid from nozzles of pressure chambers by supplying liquid from a liquid tank to said pressure chambers and then contracting said pressure chambers by means of piezoelectric elements, comprising:

pressure chamber plates forming said pressure chambers, and to which vibration plates forming walls of said pressure chambers are formed integrally; and a common liquid chamber formed in the liquid tank and connected to respective liquid supply ports of the respective pressure chambers through respective flow passages connected to said respective liquid supply ports;

wherein the liquid tank and the pressure chamber plates are mutually superimposed in a layered structure, in positions where the flow passages coincide with the liquid supply ports of the pressure chambers.

According to the present invention, pressure chamber plates form the pressure chambers, and vibration plates forming walls of respective pressure chambers are formed integrally in the pressure chamber plates; a common liquid chamber is formed in the liquid tank, and the common liquid chamber is connected to liquid supply ports of the respective pressure chambers, through respective flow passages; and the liquid tank and the pressure chamber plates are mutually superimposed in a layered structure, in positions whereby the flow passages of the common liquid chamber coincide with the liquid supply ports of the pressure chambers. Therefore, it is possible to reduce the number of components by forming integrally the pressure chambers, the vibration plates and the liquid supply ports. Furthermore, manufacturing costs can be reduced by eliminating the respective positional alignment processes for the liquid supply ports, the vibration plate and the pressure chambers. Moreover, the strength of the pressure chambers can be increased by adopting an integrated structure.

According to a second aspect of the present invention, the direction of flow of the liquid supplied to the pressure chambers from the liquid tank through the flow passages bends through 90° or less inside the pressure chambers before the liquid is ejected from the nozzles. Therefore, even if an air bubble enters into a pressure chamber, the air bubble can be removed readily through the liquid supply port, and hence the occurrence of air bubbles inside the pressure chambers can be suppressed.

According to a third aspect of the present invention, the pressure chamber plate is made from a metal material, and therefore formation of the holes for the liquid supply ports, and processing such as half-etching of the pressure chambers, can be carried out readily and processing accuracy can be improved.

According to a fourth aspect of the present invention, the pressure chamber plate is manufactured by etching, resin molding, or electroforming, and the liquid supply ports are formed by laser processing, pressing, machining, electroforming or electrical discharge machining. Therefore, it is possible to process complicated shapes which are difficult to fabricate and have poor yield when a single processing method is used.

According to a fifth aspect of the present invention, the pressure chamber plate is made from a transparent material or a semi-transparent material. Therefore, foreign matter, air bubbles, and the like, that may be present in the supply passages can be detected readily.

Moreover, in the present specification, the term "recording" indicates the concept of forming images in a broad sense, including text. Moreover, "recording medium" indicates a medium on which an image is formed by means of a head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and other materials.

According to the present invention, the number of components in the droplet ejecting apparatus is reduced and the structure thereof can be simplified.

DESCRIPTION OF THE PREFERRED EMBODIMENTS

Figure 1:
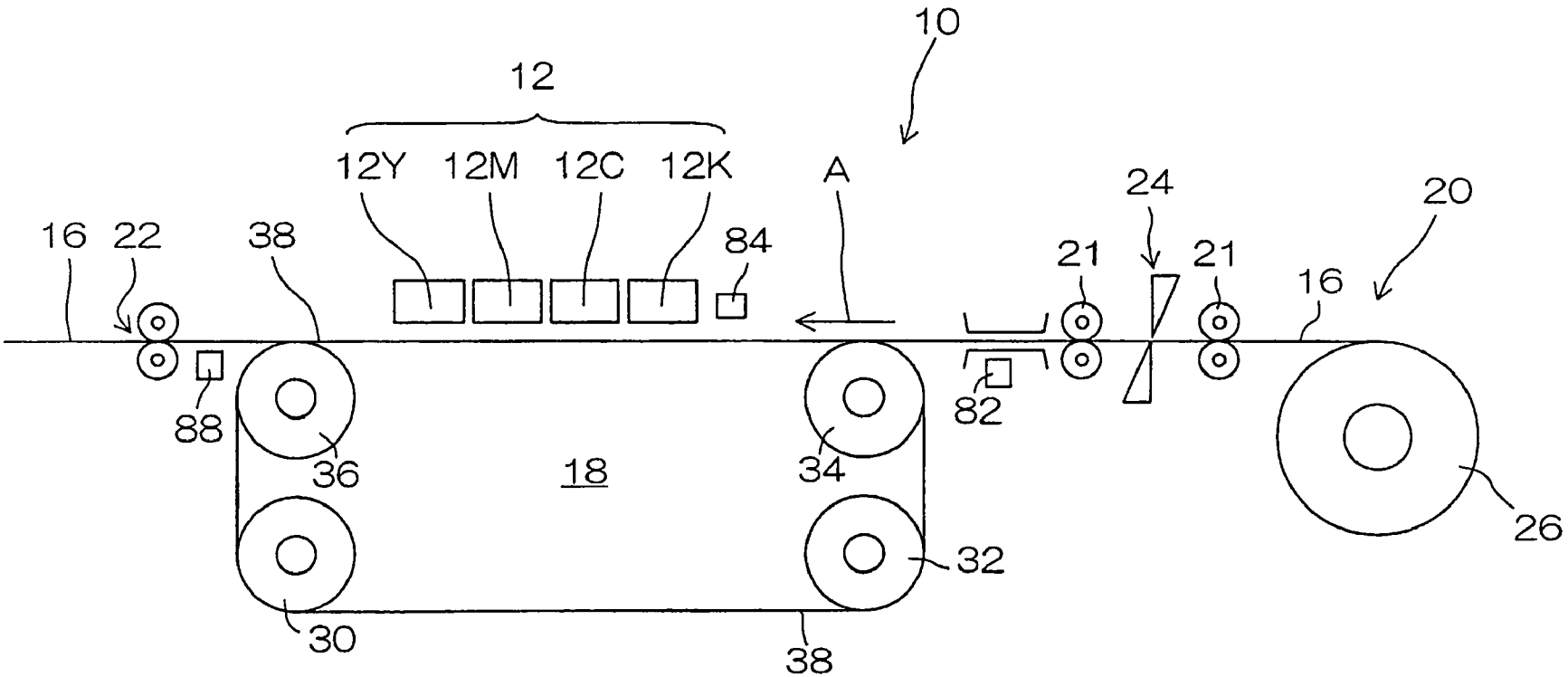
FIG. 1 is a side view showing an image forming apparatus to which a droplet ejecting apparatus relating to an embodiment of the present invention is applied.

Below, an embodiment of a droplet ejecting apparatus relating to the present invention is described with reference to the accompanying drawings. FIG. 1 is a side view showing a schematic view of the composition of an image forming apparatus 10 to which this droplet ejecting apparatus is applied.

The image forming apparatus 10 comprises recording heads 12 for each color of ink, a belt conveyance unit 18 for conveying recording paper 16 while maintaining the recording paper 16 in a flat state, disposed in a position opposing the recording heads 12, a paper supply unit 20 for supplying recording paper 16, and a paper output section 22 for outputting recording paper externally, once an image has been formed thereon.

The recording heads 12 are constituted by a so-called full line type head, wherein a line type head having a length corresponding to the width of the recording paper 16 is disposed in a fixed position, in a direction orthogonal to the paper conveyance direction. Recording heads 12K, 12C, 12M, 12Y corresponding to respective ink colors are disposed in the order, black (K), cyan (C), magenta (M) and yellow (Y), from the upstream side, following the direction of conveyance of the recording paper 16 (arrow A). A plurality of nozzles disposed in a houndstooth matrix arrangement are provided in a direction orthogonal to the conveyance direction on the lower face of each of these respective recording heads. A color image, or the like, is formed on the recording paper 16 by ejecting ink of respective colors from the nozzles 56 onto the recording paper 16, while conveying the recording paper 16.

Roll paper 26 is set in place detachably on a paper supply unit 20. Pickup rollers 21 and 21 for picking up recording paper 16 from the roll paper 26 are provided in the vicinity of the paper supply unit 20. The force of a motor (not illustrated) is transmitted to at least one of the pick-up rollers 21 and 21, and the recording paper 16 picked up thereby is conveyed from right to left in FIG. 1. Numeral 24 is a shearing cutter disposed between the pickup rollers 21 and 21, and the recording paper 16 picked up from the roller paper 26 is cut to a prescribed size by means of this cutter 24.

The belt conveyance unit 18 has a structure wherein an endless belt 38 is wound about rollers 30, 32, 34 and 36, and is composed in such a manner that at least the portion opposing the recording head 12 is a flat surface. The belt 38 has a broader width dimension than the width of the recording paper 16, and the recording paper 16 can be suctioned onto the surface of the belt. The drive force of a motor (not illustrated) is transmitted to at least one of the rollers 30, 32, 34 and 36 about which the belt 38 is wound, thereby driving the belt 38 in a clockwise direction in FIG. 1. Accordingly, the recording paper 16 suctioned onto the belt 38 is conveyed from the roll paper 26 to the paper output section 22 in FIG. 1.

Numeral 82 denotes a recording paper detection unit for reading in the position, size, and the like, of the recording paper, numeral 84 denotes a recording position detection unit for determining the timing of ink ejection onto the recording paper 16, and numeral 88 denotes a recording paper end detection unit for detecting jamming of the recording paper 16 and determining the timing for supplying the next sheet. Furthermore, a system controller (not illustrated) which controls the whole image forming apparatus 10 on the basis of the detection results from the respective detection units is provided in the image forming apparatus 10. This system controller is constituted by a central processing unit (CPU) and peripheral circuits, and the like, and it generates drive signals and control signals for the respective motors for conveying the recording paper 16, and image forming signals for the recording head 12, for example.

Figure 2:
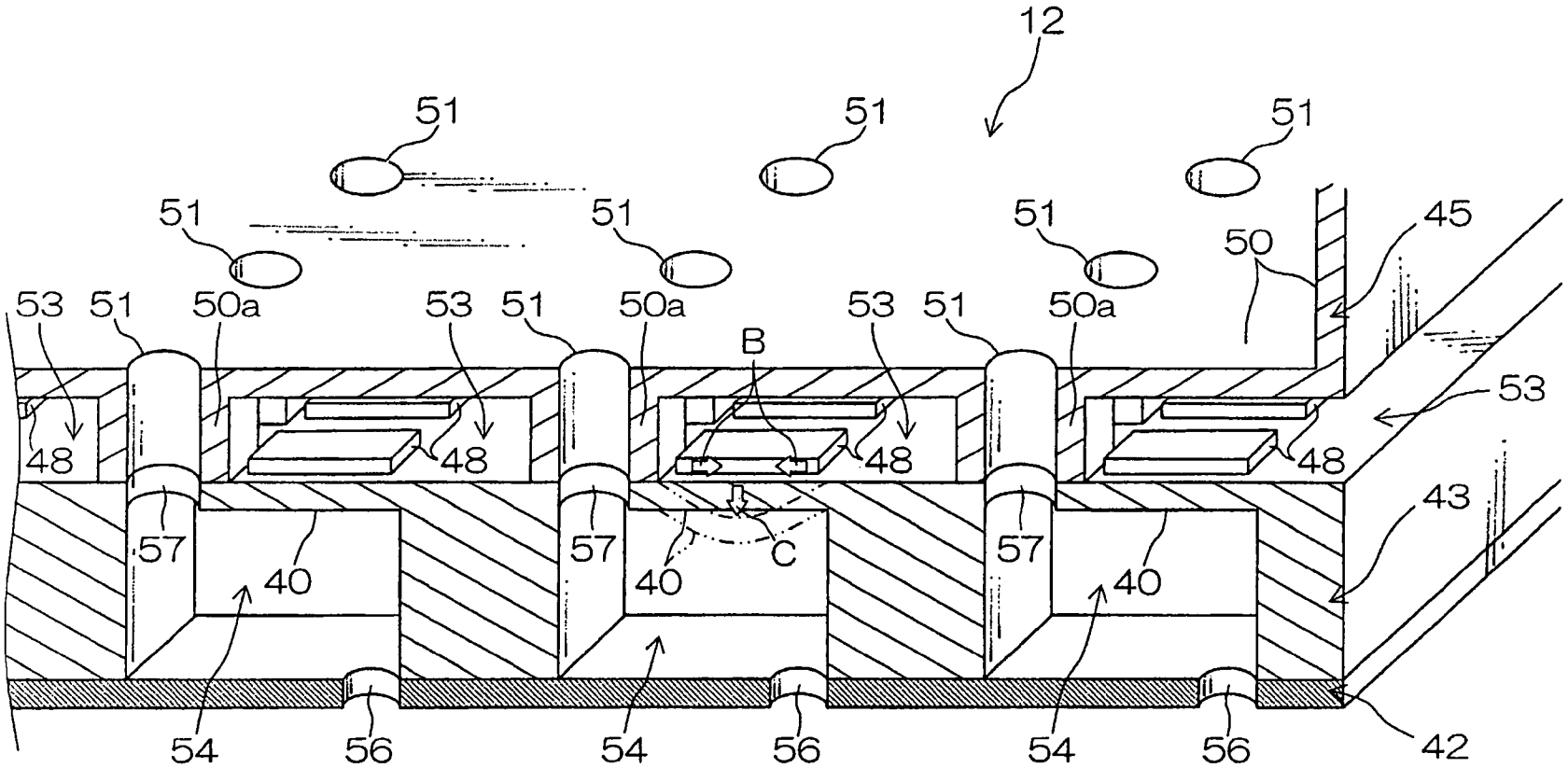
FIG. 2 is a perspective view showing the details of a recording head which forms a droplet ejecting apparatus relating to an embodiment of the present invention.

Next, the structure of the recording head 12 will be described. Since each of the recording heads 12K, 12C, 12M and 12Y provided for the respective ink colors has a similar structure, below, a recording head indicated by the numeral 12 is described as a representative example of these respective recording heads. FIG. 2 is a detailed diagram showing the structure of a recording head 12 according to the present embodiment.

The recording head 12 is composed by liquid-tightly layering a nozzle plate 42, a pressure chamber plate 43 joined to the top of this nozzle plate 42, and an ink tank 45 joined to the top of this pressure chamber plate 43, in this order.

Nozzles 56 are formed through the nozzle plate 42, which corresponds to the base section of the recording head 12. In order to achieve high density in the dot pitch of the image formed on the recording paper 16, a plurality of nozzles 56 are formed in the nozzle plate 42 in a houndstooth (staggered) matrix arrangement. In this way, a high density is achieved in the apparent nozzle pitch.

Respective pressure chambers 54 connecting with the respective nozzles 56 are formed in the pressure chamber plate 43. A vibration plate 40 comprising a thin plate portion of the pressure chamber plate 43, and a supply port 57, are formed integrally in the upper face of each pressure chamber 54 in the pressure chamber plate 43.

Piezoelectric elements 48, such as piezo elements, are fixed in positions opposing the respective pressure chambers 54, on the upper faces of the vibration plates 40. If a voltage is applied to a piezoelectric element 48 and it deforms in the transverse direction (d31 direction) (as illustrated by arrow B in FIG. 2), then the piezoelectric element 48 and the vibration plate 40 bend downwards in FIG. 2 (as illustrated by arrow C in FIG. 2), thereby contracting the pressure chamber 54 and applying pressure to same. Accordingly, the pressure chamber 54 ejects ink from the nozzle 56. An individual electrode (not illustrated) having a similar cross-sectional shape to the piezoelectric element 48 is installed on the upper face of each piezoelectric element 48, and a common electrode (not illustrated) is installed on the lower face of the piezoelectric element 48. The individual electrode is connected to a drive circuit in the image forming apparatus 10, through a connection board (not illustrated) provided in the recording head 12, and a drive voltage is applied to the individual electrode from the drive circuit.

The supply port 57 is formed in the region of the ceiling of the pressure chamber 54 where the piezoelectric element 48 is not located, and its opening is formed in the same direction as that of the nozzle 56.

The pressure chamber plate 43 having this composition is made from a metal material, and therefore processing for forming the holes of the supply ports 57, or half-etching of the pressure chambers 54 can be carried out readily. Furthermore, the pressure chambers 54 are formed by either etching, resin molding, or electroforming, and the supply ports 57 are formed by either laser processing, pressing, machining, electroforming, electrical discharge machining, or the like. In this way, the pressure chamber plate 43 is formed by complex processing based on a combination or two or more types of process. Moreover, the pressure chamber plate 43 can be manufactured by a two-stage electroforming process (which involves carrying out electroforming twice).

An ink tank 45 is layered on top of the pressure chamber plate 43. A common liquid chamber 50 for supplying ink to the respective pressure chambers 54 is formed in the ink tank 45, and flow passages 51 are formed in the leg sections 50*a* at the base of the common liquid chamber 50. These flow passages 51 are bonded and connected with the supply ports 57 of the pressure chambers 54.

A space 53 is formed between the ink tank 45 and the pressure chamber plate 43, and the piezoelectric elements 48 are disposed in this space 53. The space 53 is sealed by the upper surface of the pressure chamber plate 43 and the lower surface of the ink tank 45, thereby preventing condensation on the piezoelectric elements 48, and the like.

Next, the ink ejecting operation of the recording head 12 having the composition described above will be explained.

In order to form an image on the basis of an image forming pattern, drive voltages are applied to the individual electrode of the piezoelectric elements 48 from the drive circuit, in accordance with a system controller. The piezoelectric element 48 deforms in a transverse direction (d31 direction) (as indicated by arrow B in FIG. 2), and the vibration plate 40 which corresponds to the ceiling of the pressure chamber 54 bends in such a manner that it projects toward the pressure chamber 54 (as indicated by arrow C in FIG. 2). Thereby, a pressure wave is applied to the pressure chamber 54. Consequently, ink is ejected from the pressure chamber 54, through the nozzle 56. The ink thus ejected is propelled in the form of a droplet onto the recording face of the recording paper 16 (see FIG. 1), thereby forming an image on the recording paper 16. When application of the drive voltage is terminated, the piezoelectric element 48 and the vibration plate 40 which have deformed in this way revert to their state prior to deformation. When the piezoelectric element 48 and the vibration plate 40 revert to their original positions, new ink of approximately the same volume as the ink that has been ejected is supplied to the pressure chamber 54 from the common liquid chamber 50, through the supply passage 50*a*. The openings of the nozzles 56 are formed in a substantially parallel direction to the openings of the supply ports 57, and the direction of ink flow inside the pressure chamber 54 bends through 90° or less than 90°. Therefore, if an air bubble has entered into the pressure chamber 54, it can be removed readily, through the supply port 57. As described above, according to the droplet ejecting apparatus of the present embodiment, the supply ports 57, vibration plates 40 and pressure chambers 54 are all formed integrally in the pressure chamber plate 43, and therefore, the number of components is reduced, processes for aligning the position of the respective members, and the like, can be eliminated, and hence manufacturing costs can be reduced.

Figure 3:
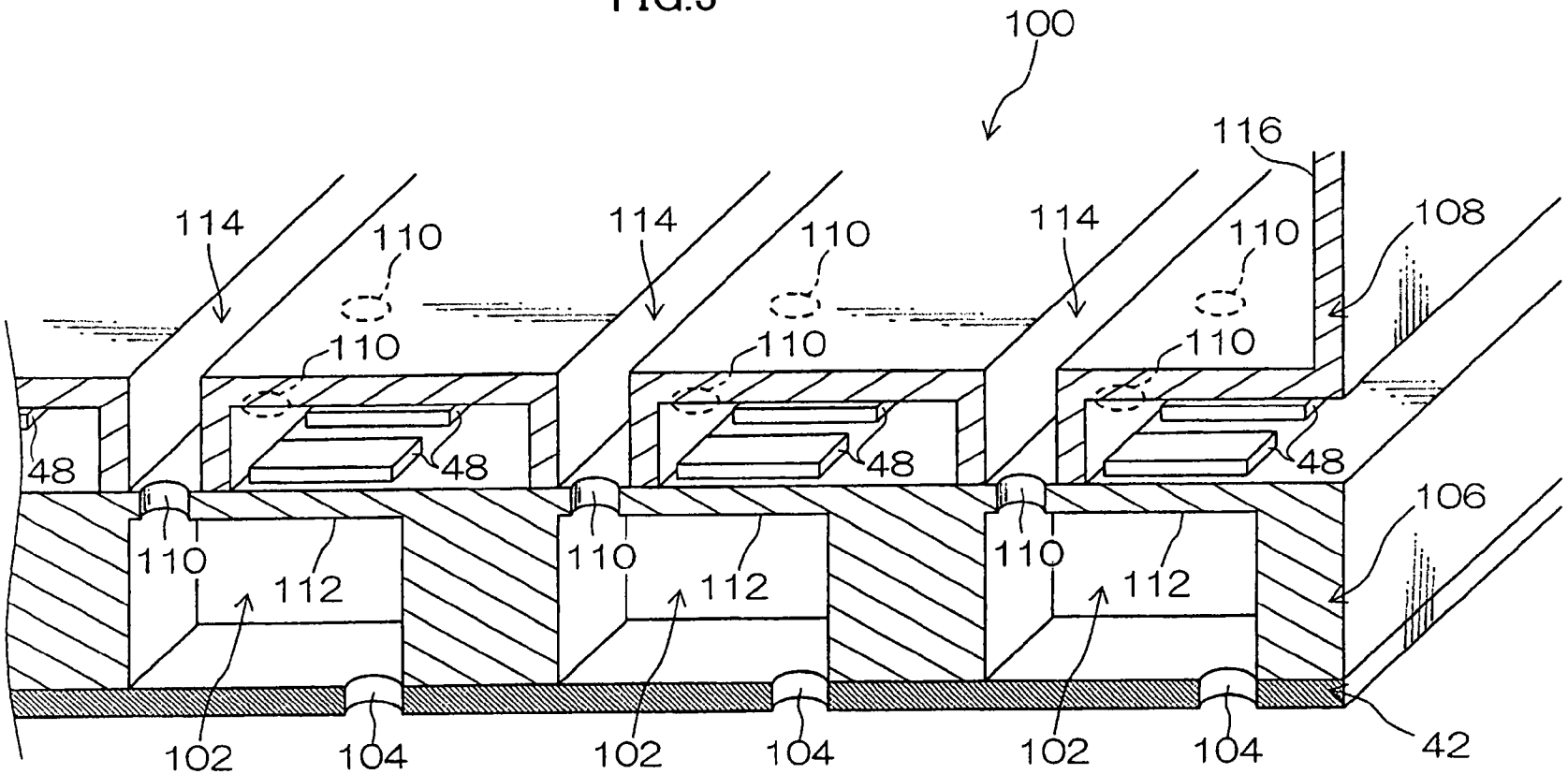
FIG. 3 is a perspective view showing another embodiment of the droplet ejecting apparatus according to the present invention.

The composition of the droplet ejecting apparatus illustrated in the foregoing embodiment is not limited to that described above. For example, the recording head 100 illustrated in FIG. 3 is composed by layering together a nozzle plate 42, a pressure chamber plate 106, and an ink tank 108 comprising supply grooves 114 instead of the flow passages 51.

The ink tank 108 is formed with a plurality of supply grooves 114 connected to a common liquid chamber 116, and supply ports 110 for the pressure chambers 102 are located in positions corresponding to the supply grooves 114.

According to the recording head 100 having this composition, since supply ports 110 formed with a smaller diameter than the width of the supply grooves 114 are disposed in the base of the supply grooves 114 of the ink tank 108, then it is possible to eliminate the work of aligning the positions of the holes in the ink tank 108 and the pressure chamber plate 106.

Figure 4:
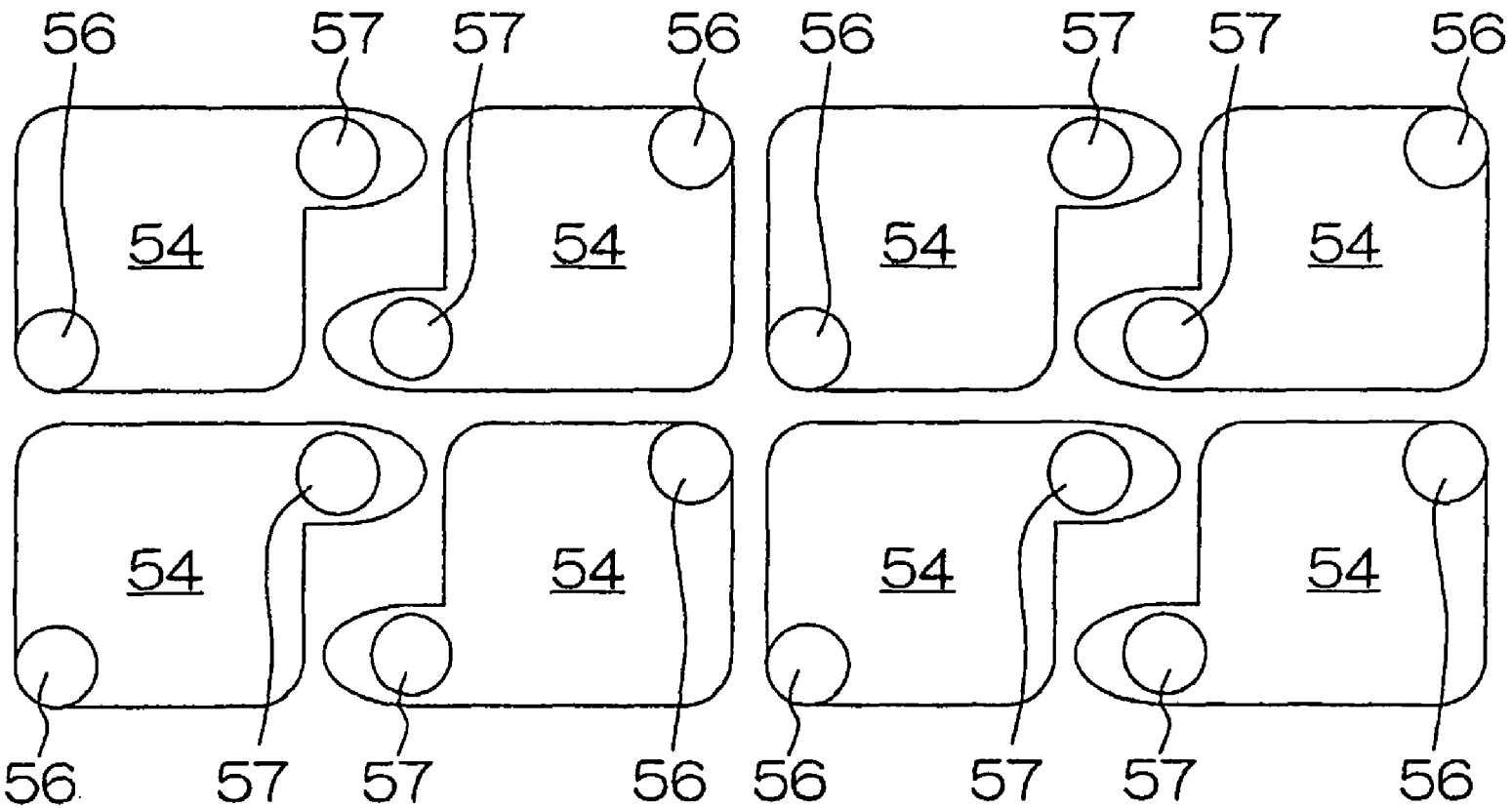
FIG. 4 is a descriptive diagram showing the arrangement of pressure chambers in the droplet ejecting apparatus according to the present invention.

FIG. 4 shows the positional relationships between the pressure chambers 54, the nozzles 56 and the supply ports 57. By forming the supply ports 57 in projecting sections, it is possible to achieve a high-density matrix arrangement of the nozzles 56.

Here, as a further mode of a droplet ejecting apparatus according to the present embodiment, the pressure chamber plate 43 is formed from a transparent or semi-transparent material. This means that foreign matter, air bubbles, or the like, present in the pressure chamber plate 43 can be detected readily. An example of a semi-transparent material of this kind is a heat-resistant polymer material having excellent electrical properties, such as a polyimide, which is used in multi-layer substrates, or the like.

What is claimed is:

1. A droplet ejecting apparatus for discharging liquid from nozzles of pressure chambers by supplying liquid from a liquid tank to said pressure chambers and then contracting said pressure chambers by means of piezoelectric elements, comprising:

pressure chamber plates forming said pressure chambers;

vibration plates forming walls of said pressure chambers; and a common liquid chamber formed in the liquid tank and connected to respective liquid supply ports of the respective pressure chambers through respective flow passages connected to said respective liquid supply ports;

wherein the liquid tank and the pressure chamber plates are mutually superimposed in a layered structure, in positions where the flow passages coincide with the liquid supply ports of the pressure chambers; and wherein the pressure chambers are formed such that a direction of flow of the liquid through the pressure chambers bends once through 90° or less, relative to an initial flow direction of the liquid entering said pressure chambers, while flowing from the liquid supply ports to the nozzles.

2. A droplet ejecting apparatus for discharging liquid from nozzles of pressure chambers by supplying liquid from a liquid tank to said pressure chambers and then contracting said pressure chambers by means of piezoelectric elements, comprising:

pressure chamber plates forming said pressure chambers;

vibration plates forming walls of said pressure chambers; and a common liquid chamber formed in the liquid tank and connected to respective liquid supply ports of the respective pressure chambers through respective flow passages connected to said respective liquid supply ports;

wherein the liquid tank and the pressure chamber plates are mutually superimposed in a layered structure, in positions where the flow passages coincide with the liquid supply ports of the pressure chambers; and wherein the individual flow passages connecting the common liquid chamber with the liquid supply ports of the pressure chambers have no bend of 90° or above, such that the flow passages continuously descend from the common liquid chamber to the liquid supply ports.

3. The droplet ejecting apparatus according to claim 2, wherein the individual flow passages are formed such that air bubbles introduced into the pressure chambers are uninterruptedly guided upward such that they can be readily removed from the pressure chambers via the common liquid chamber.

* * * * *